US007218239B2

(12) United States Patent
Ropke

(10) Patent No.: US 7,218,239 B2
(45) Date of Patent: May 15, 2007

(54) GAS OR FIRE DETECTOR WITH ALARM ANNUCIATOR HAVING A METALLIC SCREEN ANTENNA

(75) Inventor: Gerhard Ropke, Lubeck-Travemunde (DE)

(73) Assignee: Job Lizenz GmbH & Co. KG, Ahrensburg (DE)

( * ) Notice: Subject to any disclaimer, the term of this patent is extended or adjusted under 35 U.S.C. 154(b) by 178 days.

(21) Appl. No.: 11/150,959

(22) Filed: Jun. 13, 2005

(65) Prior Publication Data

US 2005/0280547 A1 Dec. 22, 2005

(30) Foreign Application Priority Data

Jun. 17, 2004 (DE) ..... 10 2004 029 242

(51) Int. Cl.
*G08B 17/10* (2006.01)

(52) U.S. Cl. ..... 340/628; 340/632; 340/693.5; 340/693.6; 340/539.1

(58) Field of Classification Search ..... 340/628–632, 340/539.1, 693.5, 693.9, 693.11, 577
See application file for complete search history.

(56) References Cited

U.S. PATENT DOCUMENTS 4,417,235 A * 11/1983 Del Grande ..... 340/531
4,851,819 A * 7/1989 Kawai et al. ..... 340/630
6,057,774 A * 5/2000 Venzant ..... 340/628
6,323,780 B1 * 11/2001 Morris ..... 340/692
6,384,790 B2 * 5/2002 Dishart et al. ..... 343/713
6,420,973 B2 * 7/2002 Acevedo ..... 340/628
6,577,242 B2 * 6/2003 Jen et al. ..... 340/693.5
2003/0142018 A1 * 7/2003 Lange ..... 343/700 MS

FOREIGN PATENT DOCUMENTS

DE 44 08 268 C2 9/1995
DE 100 54 297 A1 6/2001
JP 2002216261 A * 8/2002
WO 00/43964 7/2000

* cited by examiner

*Primary Examiner*—Jeffery Hofsass
*Assistant Examiner*—Hoi C. Lau
(74) *Attorney, Agent, or Firm*—Vidas, Arrett & Steinkraus, P.A.

(57) ABSTRACT

An alarm annunciator, particularly a gas or fire annunciator, having a casing mountable on a wall or a ceiling, which contains an alarm detector, which is in wireless connection with the surroundings of the casing via at least one opening, an electronic circuitry for the evaluation of the signals of the alarm detector, a wireless module, connected to the electronic circuitry and having an antenna for wireless receiving or sending signals to/from a sending/receiving station, and a battery for the power supply of the electronic circuitry and the wireless module, characterised in that a metallic protection screen covering the opening is designed as an antenna and is connected with the antenna output socket of the wireless module.

11 Claims, 2 Drawing Sheets

GAS OR FIRE DETECTOR WITH ALARM ANNUCIATOR HAVING A METALLIC SCREEN ANTENNA

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The transmission of signals in a wireless way (radio) is known in the alarm annunciation art since a long period of time. Fire sensors or detectors, respectively, are also known, which contain a sender for the transmission of signals to a stationary receiver, and vice versa.

From DE 44 08 268 C2 it has become known to store the received field strengths of the radio signals in the receiving apparatus on the occasion of the initial operation of the radio alarm equipment, for the purpose of operation and fail proof security. By doing so, changes in the propagation conditions of the radio waves can be recorded by means of changes of the received field strengths and can be transmitted in the data telegrams. From this, it has become further known to use different frequencies or frequency bands, because the propagation characteristics of radio waves is depending on the carrier frequency used, as is generally known.

In WO 00/43964, a wireless alarm system is described which uses a fire annunciator with a radio sender integrated with it. When a fire is discovered by the fire annunciator, it sends a radio signal. The signal is received by the receiver of a nearest-situated fire extinguisher, a very loud signal sound being given off upon the receipt of the signal, through which the fire extinguisher can be localised.

In JP 200216261 A, a sender module for a fire annunciator is described, which is powered by a battery. The arrangement of the antenna is selected such that it is situated as near as possible to the outer edge of the transmitter module in the fire annunciator, in order to provide an effective emission of the radio waves. In this solution, an optimum circle-shaped emission of the radio waves does not take place, however, because the battery is situated closely to the transmission antenna inside the fire annunciator. As is generally known, the battery is equipped with a metallic jacket, which results in shadowing of the radio waves.

In DE 100 54 297 A1, an electronic fire annunciator is described. A wireless module is hoistable to the fire annunciator from the outside as a separate component. It is advantageous in this that the antenna can be attached to the wireless module on the outside, through which optimum emission characteristics can be obtained. However, it is disadvantageous that a particular module has to be made for the radio transmission, and that a slot with several plug contacts must be provided for the connection to the fire annunciator. By using plug contacts, the safety in operation of such a fire annunciator is impaired.

Upon the emission and the reception of radio signals, several factors influence the coverage of the radio waves or its emission characteristics, respectively. In the most common applications for fire annunciators, batteries or accumulators are integrated in the fire annunciator as power sources. As mentioned already, batteries have metal casings, which are positioned relatively close to the receiving and sending antenna, respectively, in the fire annunciator. Through this, shadowing of the radio waves for certain directions takes place, and from this results a reduced coverage and also, as a result of that, an increased susceptance to trouble for the radio transmission. Arrangement and realisation of the antenna are of great importance. Through these, the maximum distance between receivers and senders for well-performing radio transmission is substantially determined.

The invention is based on the objective to provide an alarm annunciator, particularly a gas or fire annunciator, with a wireless transmitter and/or receiver module in which an optimum wave propagation characteristic is maintained, for the purpose of increasing the safety of operation and of reducing the susceptance of trouble thereof.

BRIEF SUMMARY OF THE INVENTION

In the alarm annunciator according to the invention, a metallic protection screen is provided, which covers the opening in the casing and which is realised as an antenna and which is connected with the antenna output socket of the wireless module.

Alarm annunciators, particularly gas or fire annunciators, are units which are mounted on the wall or on the ceiling of a building. A detector for the detection of a changed gas composition or of aerosols in the atmosphere is usually situated inside of a casing. In order to reach the detector, the surrounding air or aerosols or the gas, respectively, have to enter the casing via at least one opening. In order to avoid troubles, it is per se known to realise the opening such that powders or other more coarse particles which are dispersed in the air cannot enter the interior of the casing and thus impair the metering installation and provoke a false alarm. In the invention, it has been recognised that a screen, by which such an opening is closed, can be realised as a metallic screen, which is designed as an antenna at the same time. As is commonly known, the length of an antenna has to be in a certain ratio to the wavelength of the radio waves.

In order not to favour any direction for the gas, it is common to distribute openings over the perimeter of the casing, through which a fluid communication is established between the detector and the surroundings of the annunciator. Thus, with the aid of the protection screen, covering of all the openings can take place at the same time, and by doing so, an appropriate length dimension for the screen can be selected. As the openings are relatively far apart from the battery in the annunciator casing, the interfering effect on the sending- or reception process is reduced. Furthermore, the openings in the annunciator casing are mostly in a certain distance to the ceiling or the wall of the building, which is favourable for the propagation characteristics.

For the realisation of the described invention, several design solutions are imaginable. According to one embodiment of the invention, the length of the protection sleeve is an integer fraction of the wavelength of the sent or received signals. As is commonly known, the relation between wavelength, frequency and light velocity is $$\lambda = \frac{c}{f}$$

Wherein $\lambda$ is the wavelength, c the light velocity and f the frequency. If a frequency of e.g. 433 MHz is selected, $\lambda$=69.28 is valid. An optimum antenna dimension is obtained at an antenna length of λ, λ/2, λ/4 and λ5/8. Thus, an antenna length λ/4 is 17.32 cm. With a frequency of 868 MHz, an antenna length of 17.28 cm results for λ/2. This is a dimension which is acceptable for a protection screen inside the annunciator casing.

The protection screen, and thus the antenna, is preferably circle-shaped, the circle being divided, i.e. the ends of the protection screen are not in any electrical connection with each other. Preferably, the wireless module is connected with one end of the protection screen. Thus, by variation of the distance between the ends, the length of the protection screen or the optimum antenna length, respectively, can be adjusted.

According to one form of realisation of the invention, it is provided that the protection screen is disposed in a first plane of the casing and that the measuring chamber containing the detector is arranged in that plane. In a second plane, which is situated nearer to the wall or ceiling, the wireless module is disposed. Through this, a further spatial separation between the antenna on the one hand and the battery on the other hand is achieved.

Preferably, the battery is disposed in a third plane of the casing, which on its part is located nearer to the wall or ceiling than the second plane.

According to a further form of realisation of the invention, the last described design is realised in that the casing consists of three parts, namely, an annunciator carcass which is fixable on the wall or ceiling and which accommodates the battery, a shell portion, which is attachable on the annunciator carcass and which holds the wireless module, an electronic circuitry and the detector, and a cap portion, which is detachably connectable with the shell portion and which accommodates the protection screen and the detector. By removing the cap portion from the shell portion, the interior of the measuring chamber is accessible and can be serviced, as well as the protection screen, which has to be cleaned, as the case will be. By removing even the shell portion from the annunciator carcass, the electronic circuitry and the wireless module are accessible.

BRIEF DESCRIPTION OF SEVERAL VIEWS OF THE DRAWINGS

The invention is explained in more detail below, by means of a realisation example which is represented in drawings.

DETAILED DESCRIPTION OF THE INVENTION

Figure 1:
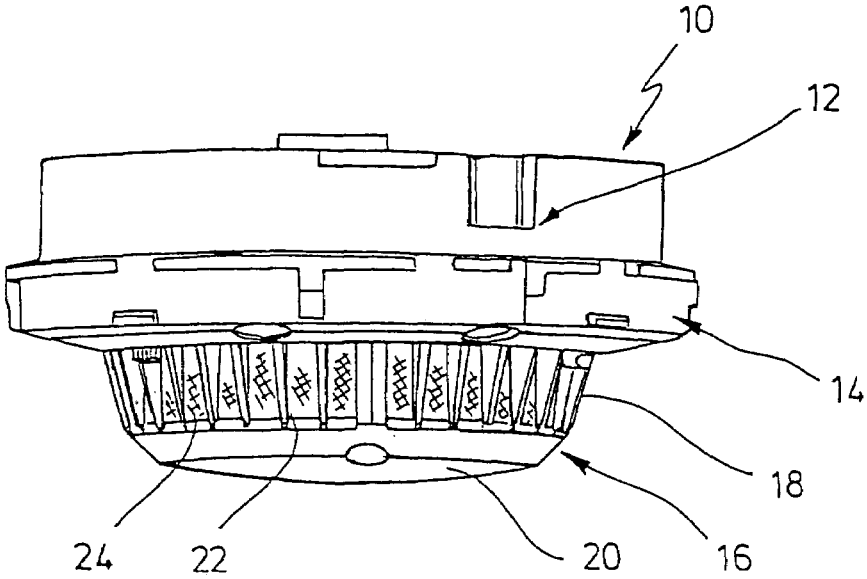
FIG. 1 shows a perspective view of an alarm annunciator according to the invention.

While this invention may be embodied in many different forms, there are described in detail herein a specific preferred embodiment of the invention. This description is an exemplification of the principles of the invention and is not intended to limit the invention to the particular embodiment illustrated In FIG. 1, a fire annunciator 10 is represented, the casing of which consists of three parts, namely, an annunciator carcass 12, which is mountable on a (not shown) wall or a ceiling, a shell portion 14 and a cap portion 16. The shell portion 14 is detachably attachable on the carcass portion 12 by screws or via a snapping connector, and the cap portion 16 is detachably attachable on the shell portion 12 with the aid of screws or by a snapping connector.

Figure 4:
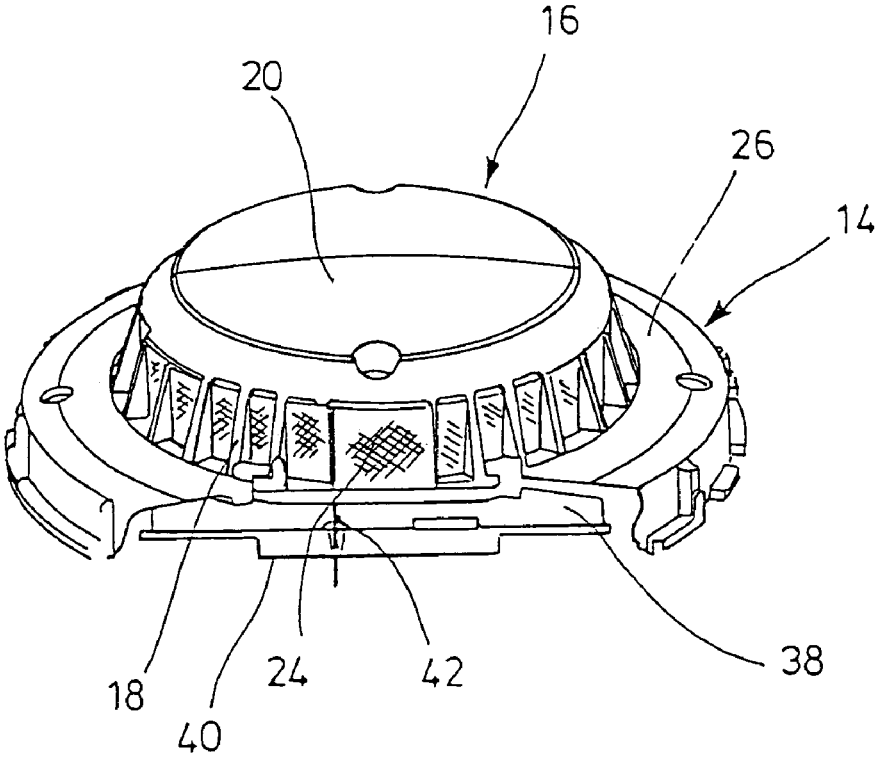
FIG. 4 shows a similar representation as does FIG. 1, but rotated about 180°, again with removed parts.

In FIG. 1 it can be further seen that the cap portion 16 has equally distanced ribs or bridges 18 in its perimeter direction, which are connected to a bottom portion 20. Through this, flow openings 22 are formed, by which a connection between then interior of the fire annunciator 10 and the surroundings is formed. The openings 22 are covered by a metallic protection screen 24 on the inner side of the ribs 18. In FIG. 4 it can be recognised that the ribs 18 are connected on the side opposite to the portion 20 through an annular flange 26, which is accommodated in an annular-shaped recess 28 (FIG. 2) of the shell portion 14.

An inner wall area 30 of the shell portion 14 delimits a measuring chamber. On the wall chamber 30, an infrared sending diode 32 is attached, and a receiving diode 34 "looks" into the measuring space which is delimited by the wall area 30, a shadowing element 34*a* preventing that direct light from the sending diode 32 reaches the receiving diode 34.

Figure 2:
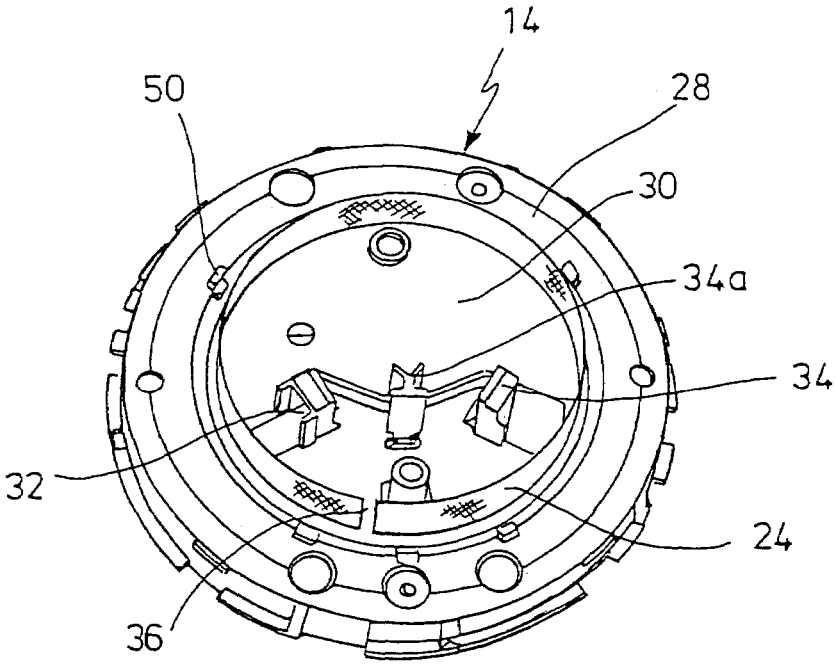
FIG. 2 shows a perspective view of the shell portion, with a protection screen for the not shown cap portion.

In FIG. 2, the cap portion 16 is removed, but the screen 24 is leaved. As can be recognised, the metallic screen 24 is disposed as being circularly shaped, but with a nip 36 being formed between the free end of the screen 24. As already mentioned, the screen 24 is situated on the inner side of the ribs 18 when the cap portion 16 is attached, and thus it prevents the invasion of insects and of dirt.

Figure 3:
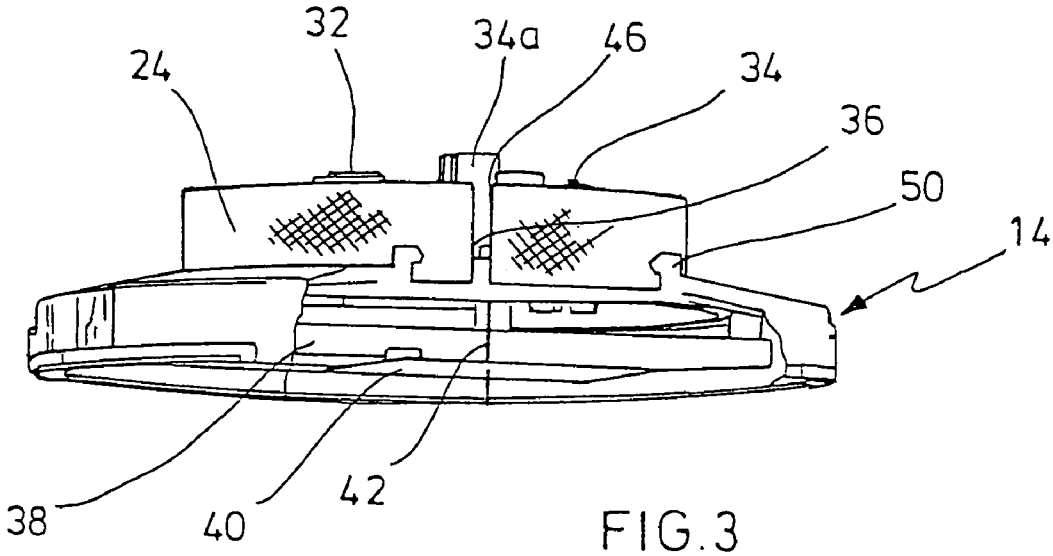
FIG. 3 shows a side view of the representation after FIG. 2 with partially removed parts.

From the FIGS. 3 and 4 it can be recognised that a printed circuit board 38 is arranged on the side of the shell portion 14 opposite to the screen 24, on which the electronic circuitry for the operation of the shown annunciator 10 is disposed. Below the printed circuit board after FIG. 3 or 4, a wireless module 40 is attached. The wireless module is connected with a wire 42, which is guided vertically to the printed circuit board 38 through the wall portion 30 and which, as can be recognised particularly in FIG. 3, is connected with one end of the protection screen 24, as shown at 46. Thus, the protection 24 screen is the antenna for the wireless module 40, its length having a dimension which is adapted to the wavelength of the transmission frequency.

In the assembly of the shown parts, the cap portion 16 is put onto the shell portion 14, wherein a snapping connection can be established, as is indicated by the tongues 50 in FIG. 3. The unit of cap portion 16 and shell portion 14 can be mounted on the carcass portion 12 with the aid of screws, as is indicated in FIG. 1

It is to be understood that the wireless module can be designed as a receiving module as well as a sending module or as both, respectively.

It should still be mentioned that in the carcass portion 12 a battery or an accumulator is arranged, which supplies electrical energy to the wireless module 40, the printed circuit board 38 and to the detector 32, 34.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. An alarm annunciator, particularly a gas or fire annunciator, having a casing mountable on a wall or a ceiling, which contains an alarm detector, which is in wireless connection with the surroundings of the casing via at least one opening, an electronic circuitry for the evaluation of the signals of the alarm detector, a wireless module, connected to the electronic circuitry and having an antenna for wireless receiving or sending signals to/from a sending/receiving station, and a battery for the power supply of the electronic circuitry and the wireless module, characterised in that a metallic protection screen (24) covering the opening (22) is designed as an antenna and is connected with the antenna output socket of the wireless module (40).

2. An alarm annunciator according to claim 1, characterised in that the length of the protection screen (24) is an integer fraction of the wavelength of the sent or received signals.

3. An alarm annunciator according to claim 1, characterised in that the protection screen (24) is not electrically connected on its ends.

4. An alarm annunciator according to claim 3, characterised in that the antenna output socket is connected with one end of the protection screen (24).

5. An alarm annunciator according to claim 1, characterised in that the protection screen (24) is circle-shaped.

6. An alarm annunciator according to claim 1, characterised in that the protection screen (24) is disposed in a first plane of the casing and is assigned to a measuring chamber containing the detector (32, 34) and that the wireless module (40) is disposed in a second plane of the casing, which is situated nearer to the wall or ceiling.

7. An alarm annunciator according to claim 6, characterised in that the wireless module (40) is an integral part of a printed circuit board (38) for the electronic circuitry, or is attached to it.

8. An alarm annunciator according to claim 6, characterised in that the battery is disposed in a third plane of the casing, which is situated nearer to the wall or ceiling than the second plane.

9. An alarm annunciator according to claim 6, characterised in that the casing has an annunciator carcass (12), accommodating the battery and being mountable on the wall or ceiling, a shell portion (14), holding the electronic circuitry, the wireless module (40) and the detector, detachably connectable with the annunciator carcass, and a cap portion (16), detachably connectable with the shell portion, forming the opening (22) and accommodating the protection screen (24).

10. An alarm annunciator according to claim 9, characterised in that the annunciator carcass (12), the shell portion (14) and the cap portion (16) have a circle-shaped diameter.

11. An alarm annunciator according to claim 9, characterised in that the cap portion (16) has approximately vertical ribs (18), spaced apart from each other in the perimeter direction, which constitute several openings (22), which are covered by the protection screen (24) on the inner side of the cap portion (16).

* * * * *